United States Patent [19]

Hara

[11] Patent Number: 5,035,118

[45] Date of Patent: Jul. 30, 1991

[54] AUTOMATIC ICE MAKING MACHINE

[75] Inventor: Yasuo Hara, Toyoake, Japan

[73] Assignee: Hoshizaki Denki Kabushiki Kaisha, Aichi, Japan

[21] Appl. No.: 510,036

[22] Filed: Apr. 16, 1990

[51] Int. Cl.[5] ..... F25C 1/12

[52] U.S. Cl. ..... 62/126; 62/129; 62/233

[58] Field of Search ..... 62/126, 138, 233, 125, 62/129, 130, 158

[56] References Cited

U.S. PATENT DOCUMENTS

| | | | |
|---|---|---|---|
| 2,695,502 | 11/1954 | Muffly | 62/138 |
| 4,601,176 | 7/1986 | Suyama | 62/138 |
| 4,909,039 | 3/1990 | Yamada et al. | 62/125 X |
| 4,932,216 | 6/1990 | Ito | 62/129 |

OTHER PUBLICATIONS

"Computer Control of Industrial Processes", Emmanuel Savas, pp. 19–20, McGraw-Hill, 1965.

*Primary Examiner*—William E. Tapolcai

*Attorney, Agent, or Firm*—Koda and Androlia

[57] ABSTRACT

Disclosed is an automatic ice making machine having an ice making section equipped with an evaporator connected to a freezing system, a system for feeding a water to be frozen to said ice making section, an ice formation detector, and an ice releasing unit which releases ice cakes formed in the ice making section upon receipt of ice formation signal from said ice formation detector; characterized in that said ice making machine further comprises an alarm unit which gives an alarm after a predetermined time counted from the starting point of the ice making operation, provided that the ice formation detector outputs no ice formation signal. The alarm unit is designed to give a predetermined alarm sound or sign and also to actuate the ice releasing unit or to stop the operation of the ice making machine. The ice formation detector may be any of temperature detection system, pressure detection system and ice thickness detection system.

4 Claims, 5 Drawing Sheets

AUTOMATIC ICE MAKING MACHINE

BACKGROUND OF THE INVENTION

This invention relates to an automatic ice making machine, more particularly to an automatic ice making machine having a measure which can effectively prevent accidents such as burning of compressor and waste of power or water to be frozen by giving an alarm externally at an early stage to notify presence of trouble whenever the normal ice making operation is hindered for some reasons.

Various types of automatic ice making machines for continually making various shapes of ice cakes including cube and plate in large quantities are utilized suitably depending on the applications. For example, popular ice making machines include:

(1) so-called closed cell system ice making machines having a multiplicity of freezing cells opening downward formed in a freezing chamber, in which the freezing cells can separably be closed with a water tray, and a water for freezing is injected into the freezing cells through the water tray to form ice cubes gradually therein;

(2) so-called open cell system ice making machines having a multiplicity of freezing cells opening downward, in which a water to be frozen is directly injected into the freezing cells in the absence of the water tray to form ice cubes in the freezing cells; and (3) flow-down system ice making machines having a tilted freezing plate, in which a water to be frozen is supplied to flow on the upper or lower surface of the freezing plate to form an ice plate on the corresponding surface.

These automatic ice making machines generally have an ice making mechanism in the upper part of the machine body and a freezing system for cooling said ice making mechanism at the lower part thereof, said freezing system comprising a compressor, a condenser, a capillary tube, an evaporator, etc.

The evaporator, a constituent of the freezing system, is disposed in the ice making section constituting the heart of the ice making mechanism and designed to cool the ice making section. A water to be frozen is circulably fed to the ice making section and frozen to form ice cakes. Upon detection of the growth of the ice to a predetermined size by an ice formation detector, feeding of the water to be frozen is stopped. Subsequently, by the selective operation of a valve, a heated gaseous cooling medium from the compressor is adapted to be fed through a bypass tube to the evaporator to heat the ice making section and allow the ice cakes formed therein to drop by their own weight, whereby the ice cakes thus released are collected and accumulated in a stocker disposed below the ice making section.

As the ice formation detector, various detection modes have conventionally been employed. For example:

(1) temperature detecting mode, in which a temperature element such as thermostat or thermistor disposed in the freezing chamber detects the temperature drop which occurs as the ice cakes grow to find the completion of ice cake formation;

(2) water level detecting mode, in which a water level detector disposed in the water tank detects drop of the water level to a predetermined level after the water to be frozen is fed out therefrom with the growth of ice cakes to find the completion of ice cake formation;

(3) pressure detecting mode, in which a pressure detector disposed on the discharge side of a circulating water pump detects the change in the discharge pressure of the pump to know the completion of ice cake formation; and (4) ice thickness detecting mode, in which an ice thickness detector disposed in the freezing chamber or on a freezing plate detects growth of the ice block to a predetermined thickness to know the completion of ice plate formation.

In an automatic ice making machine in which any of the various types of ice making modes as described above can be employed, if clogging occurs, for example, in the condenser as the result of dust deposition on the radiator fins thereof, heat dissipation from the condenser is prevented to show reduced condensing power and require longer time for making ice cakes, whereby not only the freezing power is lowered but also the compressor is overheated to show reduced permanence, disadvantageously. For such reasons, the conventional automatic ice making machines have an alarm unit which gives a predetermined alarm when a temperature element such as thermistor disposed on the outlet pipe side of the condenser detects a temperature drop below a predetermined level.

As described above, in the conventional automatic ice making machine having a temperature element disposed on the outlet pipe side of the condenser, it is generally difficult to preset the actuation temperature for the temperature element and the following problems arise.

For example, at the initial stage of the ice making operation, the evaporator in the freezing system is subjected to high load for cooling a normal temperature water to be frozen supplied from the external water supply system, so that the condensation load is increased to elevate the temperature of the cooling medium on the discharge side of the condenser. After circulation of the cooling medium in the freezing system for some time, the water to be frozen is gradually cooled to have a lower temperature to require smaller load of the condenser, and in turn the temperature of the cooling medium from the outlet of the condenser is lowered. Thus, while the temperature of the cooling medium on the outlet side of the condenser is temporarily elevated at the early stage of ice making operation, the temperature element in the conventional automatic ice making machine even detects such temporary phenomenon and gives an alarm, disadvantageously. In other words, the alarm unit is actuated every time the ice making operation is initiated, and such alarm must be regarded as an error, since it is not attributable to essential abnormality such as trouble, and thus making the alarm system quite unreliable from the standpoint of maintenance.

Then, if the actuation temperature for the temperature element is set to a higher level so as to prevent such accident, the above alarm error can be prevented but a new problem arise that the alarm unit is not actuated until the clogging in the condenser becomes heavy. When the alarm unit is not actuated even when the clogging in the condenser proceeds to a substantial degree, troubles such as lowering of freezing power and deterioration of the compressor parts occur.

Further, when the environmental temperature drops such as in winter, not only the temperature of the entire freezing system but also that of the water supplied from the external water supply system drop. In this case, even if there is a substantial degree of clogging in the condenser, the temperature of the cooling medium on the discharge side of the condenser drops below the actuation temperature of the temperature element. In other words, in spite of the lowered freezing power, the alarm unit is not actuated, disadvantageously.

In addition to the problems described above, the conventional automatic ice making machine having a temperature element on the discharge pipe of the condenser also involves the following problems.

(1) When a hot gas valve disposed in a hot gas circuit connecting the discharge side of the compressor and the evaporator is out of order to causes malfunction in the closing operation of the valve, the heated hot gas flows into the evaporator during the ice making operation to hinder the growth of ice cakes in the ice making section. In such occasion, the ice making mechanism is incapable of making ice cakes, so that the ice formation detector is not actuated to allow the ice making operation to continue without forming any ice cakes wasting power. Moreover, the above alarm unit never gives an alarm since it cannot detect such operational error.

(2) When the water feed valve of the external water supply system is out of order to cause water leakage, the leaked water is also introduced to the water tank. Since the leaked water is of normal temperature, the entire water being cooled under circulation is subject to temperature rise when the amount of such leaked water is great to inhibit formation of ice cakes, and thus the ice making operation is likewise continued without forming any ice cakes, leading to the waste of power and water. On the other hand, if the amount of the leaked water is small, the ice cakes may grow but at a slow pace. In other words, the ice making operation time is extended to lower the freezing power, and increased amounts of power and water are consumed for making the same amount of ice cakes. However, the above alarm unit does not give an alarm in such occasions since it cannot detect such abnormal ice making operation.

(3) When the ice formation detector is out of order, the ice making operation is continued even after ice cakes are formed to a full size. Accordingly, not only properly grown ice cakes cannot be secured but also an excessively large ice block grows in the ice making section. For example, the ice block grows to reach and damage the water feed system including the water tray, water sprinkling pipe and water tank. Nevertheless, the ice making operation is continued only to waste power.

The above alarm unit never gives an alarm since it cannot detect such operational error.

This invention has been proposed in view of the above problems inherent in the conventional automatic ice making machines and to solve them properly, and is directed to provide an automatic ice making machine having an alarm unit which can successfully prevent deterioration of the compressor and waste of power or water, free from alarm error.

SUMMARY OF THE INVENTION

The automatic ice making machine of this invention is designed to give an alarm after a predetermined time from the starting point of the ice making operation when the ice making mechanism requires a longer time for ice making or rendered incapable of making ice cakes due to some trouble, for example, in the hot gas valve or water feed valve, provided that no ice formation signal is outputted from the ice formation detector. Accordingly, erroneous detection by the temperature element of the temporary temperature rise in the cooling medium on the discharge side of the condenser at the initial stage of the ice making operation to give alarm can be prevented and an alarm can be given correctly whenever a trouble occurs, so that users can immediately cope with various troubles. Accordingly, not only the life of compressor and other units can be extended but also power and water can be saved, advantageously.

BRIEF DESCRIPTION OF THE DRAWINGS

The attached drawings show preferred embodiments of the automatic ice making machine according to this invention.

PREFERRED EMBODIMENTS OF THE INVENTION

The automatic ice making machine of this invention will be described below by way of preferred embodiments referring to the attached drawings.

Figure 1A:
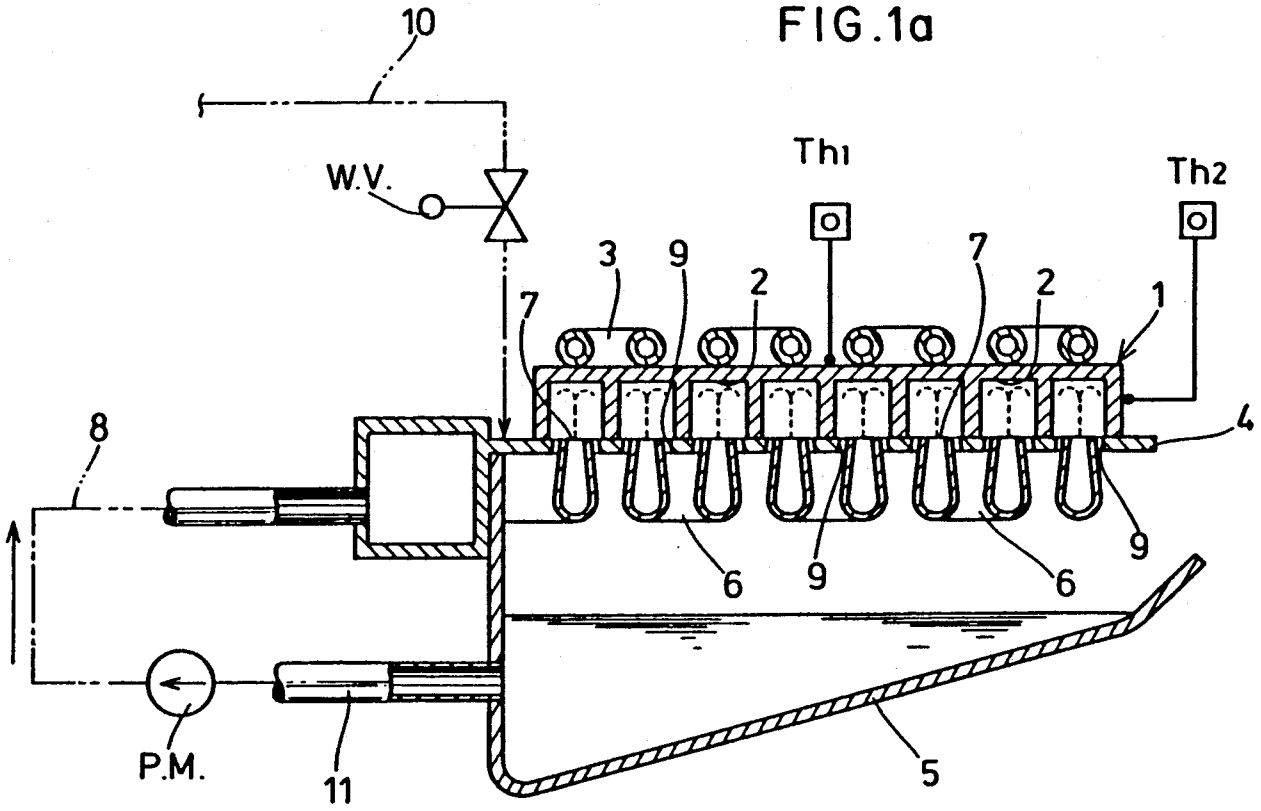
FIG. 1 shows a constitution of the major section of the automatic ice making machine.
Figure 1B:
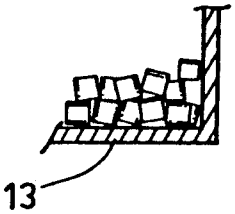

FIG. 1 shows an example of the automatic ice making machine in which the present invention can suitably be embodied. The automatic ice making machine has a freezing chamber 1 with a multiplicity of freezing cells 2 opening downward defined therein, and an evaporator 3 which is a constituent of the freezing system is disposed on the external upper wall surface of the freezing chamber 1. A water tray 4 is also disposed tiltably below the freezing chamber 1 to normally close the freezing cells 2 upwardly into a horizontal posture. The water tray 4 is supported pivotally at one end portion by means of a pivot not shown and forced to be tilted by an actuator during the ice releasing operation to allow the freezing cells 2 to be open. On the lower surface of the water tray 4, a distribution pipe 6 is disposed for feeding the water to be frozen into each freezing cell 2, and further a water tank 5 is disposed below the water tray 4. A predetermined amount of water to be frozen necessary for one cycle of ice making operation is fed into the tank 5 through a water feed valve WV from the external water supply system 10.

The water within the water tank 5 is fed out from a lower position thereof through a water feed pipe 11 and a pump PM to the distribution pipe 6 and injected into each of the freezing cells 2 through multiplicity of water injection holes 7 formed in the water tray 4 correspondingly with the freezing cells. The water to be frozen is partly frozen onto the internal wall surface of each freezing cell 2, and the unfrozen water is fed back to the water tank 5 through water discharge holes 9 defined, on the water tray 4, adjacent to the respective water injection holes 7. The water to be frozen is circulated through the water feed system 8 having such constitution to allow ice layers to grow gradually in the freezing chamber 1.

On the external upper wall surface of the freezing chamber 1, a temperature detector $Th_1$ comprising a temperature element such as thermostat and thermistor is closely disposed. The temperature detector $Th_1$ is designed to detect the temperature of the freezing chamber 1 and to be actuated to complete the ice making operation when the ice cakes in the freezing cells 2 grow fully to lower the temperature of the freezing chamber 1, and then it causes to start another cycle of ice releasing operation.

In the automatic ice making machine shown in FIG. 1, the pump PM is stopped when ice releasing operation is started to stop feeding of the water to be frozen, and the water tray 4 and the water tank 5 are tilted to a predetermined angle under the operation of the actuator not shown to discharge the unfrozen water remaining in the water feed system 8 completely. By the selective operation of the valve, a hot gas is fed into the evaporator 3 connecting to the freezing system to warm the freezing chamber 1, so that the ice cakes formed in the freezing cells 2 may drop by their own weight to be guided into the ice reservoir 13.

The completion of dropping of the ice cakes into the ice reservoir 13 is detected by a temperature detector $Th_2$ comprising a temperature element such as thermostat and thermistor closely disposed on the external side wall surface of the freezing chamber 1 upon detection of the temperature rise in the freezing chamber 1. After detection of the completion of dropping of the ice cakes, the actuator is driven reversely to return the water tray 4 and the water tank 5 to the original horizontal position and close the freezing cell 2 upwardly, whereupon another portion of fresh water to be frozen is supplied into the water tank 5 through the water feed valve WV from the external water supply system 10. The pump PM then starts feeding the water to be frozen into the freezing chamber 1, and the ice making operation is resumed.

Figure 2:
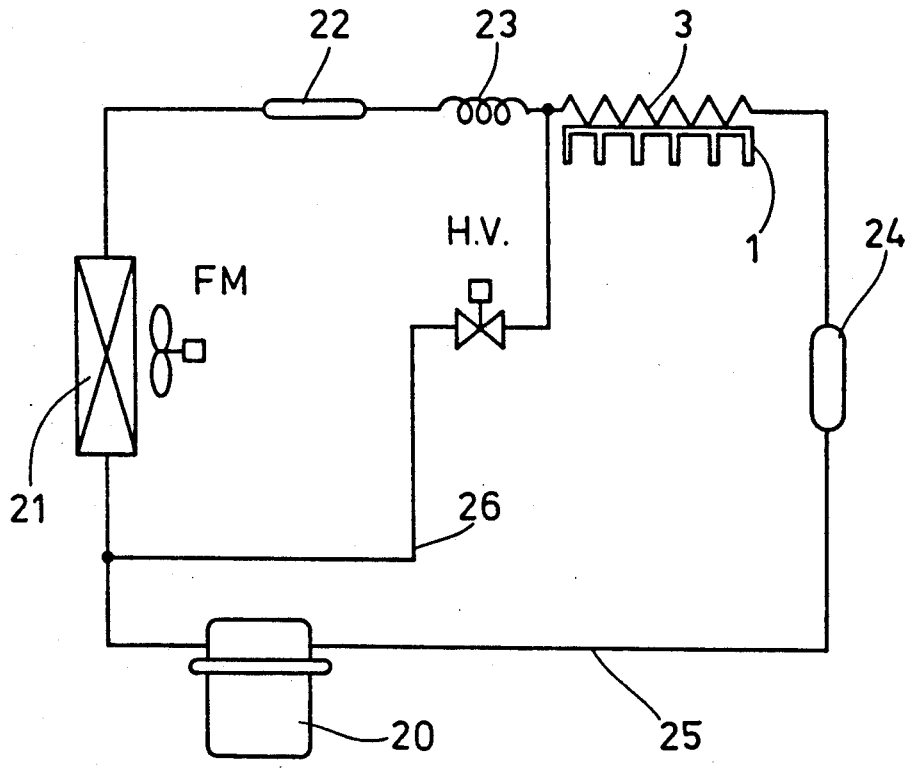
FIG. 2 shows a schematic view of the freezing system of the automatic ice making machine.

FIG. 2 shows schematically a constitution of the freezing system. The gaseous cooling medium compressed in a compressor 20 is condensed in a condenser 21 and liquefied. After desiccation in a dryer 22, the liquefied cooling medium is subjected to pressure reduction through a capillary tube 23 and then to evaporation in the evaporator 3 disposed on the external upper wall surface of the freezing chamber 1, and upon heat exchange with the water to be frozen injected into the respective freezing cells 2, the water to be frozen is allowed to freeze within the respective freezing cells 2. The gasified cooling medium in the evaporator 3 and the liquid cooling medium remaining ungasified flow into an accumulator 24 as a gas-liquid mixture, where they are separated into the respective phases; the gaseous phase cooling medium is fed back to the compressor 20 through a suction pipe 25, whereas the liquid phase cooling medium remains in the accumulator 24. Incidentally, the mark FM in FIG. 2 shows a fan motor for the condenser 21.

A hot gas pipe 26 branched from the discharge side of the compressor 20 communicates to the charge side of the evaporator 3 through a hot gas valve HV. Accordingly, the heated cooling medium discharged from the compressor 20 during the ice releasing operation flows into the evaporator 3 through the hot gas pipe 26 and the hot gas valve HV to heat the freezing chamber 1 and in turn the spherical surfaces of the ice cakes formed in the respective freezing cells 2 so that they may drop by their own weight. The heated cooling medium flowed out of the evaporator 3 then flows into the accumulator 24 to heat and evaporate the liquid phase cooling medium staying therein, which is fed back in gas phase through the suction pipe 25 to the compressor 20.

Figure 3:
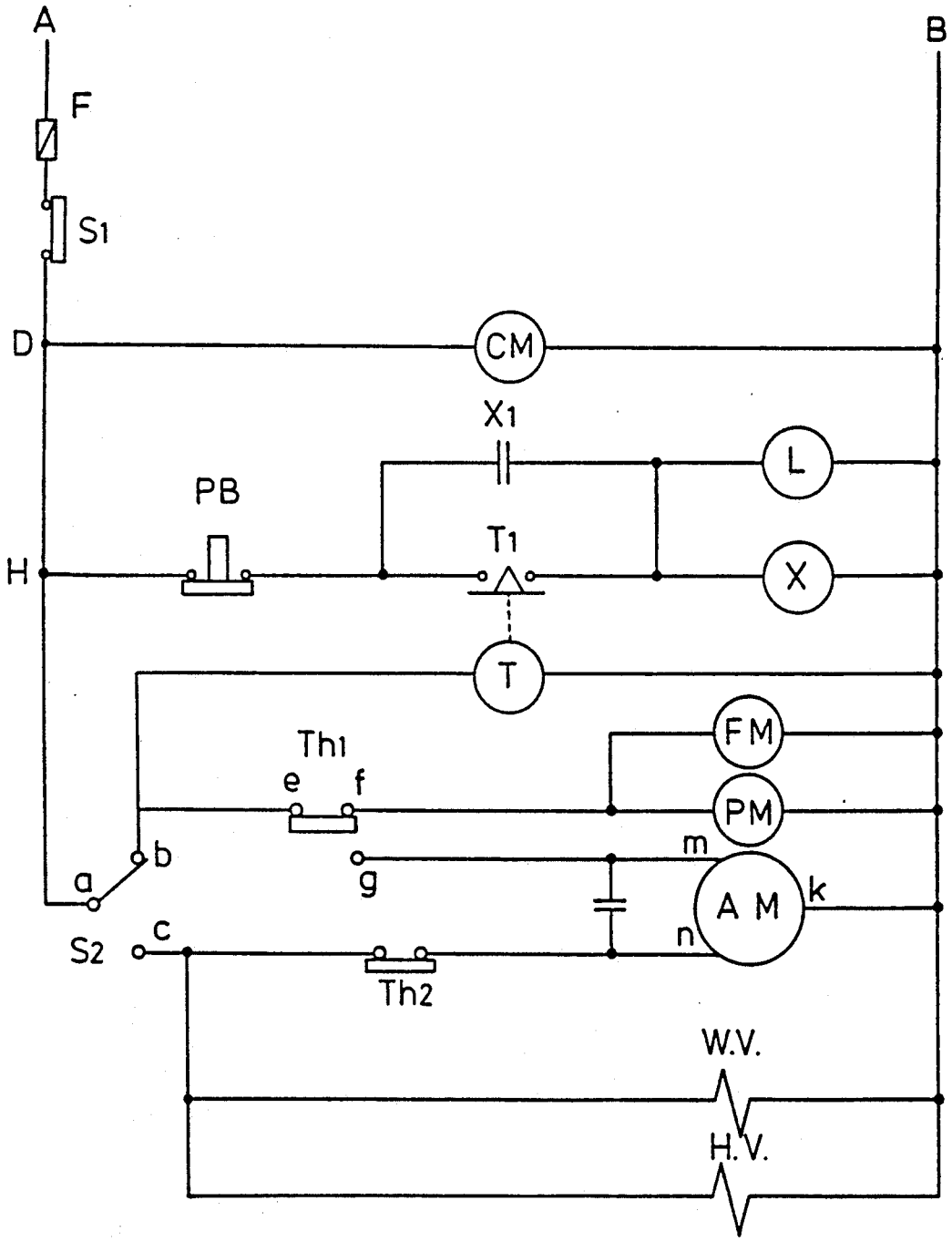
FIG. 3 shows an electric control circuit diagram of a first embodiment of the automatic ice making machine of this invention.

FIG. 3 shows an example of electric control circuit diagram of the automatic ice making machine according to a first embodiment of this invention. In the drawing, a fuse F and an ice formation detector switch $S_1$ are disposed serially between a power supply line A and the connecting point D connected to another power supply line B through a compressor CM. The ice formation detector switch $S_1$ is designed to be closed when the amount of ice cakes in the ice reservoir 13 is decreased below a predetermined level and to be open when it reaches the predetermined level. Between another connecting point H and the power supply line B a reset push button PB, a normally open contact $T_1$ for a timer T (to be described later) and a relay X are serially connected, and further a normally open contact $X_1$ and an alarm lamp L are serially connected parallel to the normally open contact $T_1$ and the relay X. In this embodiment, the timer T, the alarm lamp L and the relay X constitute an alarm unit.

The contact a of a change-over switch $S_2$ which is urged to be changed over when the water tray 4 is tilted for the ice releasing operation is connected to the connecting point H. The contact b of this change-over switch $S_2$ is connected to the contact e of a temperature detector $Th_1$ and also to the timer T connected to the power supply line B. The timer T is designed to close the normally open contact $T_1$ for a predetermined time after a preset period counted from the initiation of energization (starting point of the ice making operation), and the closing time is preset to be slightly longer than the time required for the normal ice making operation.

Further, a fan motor FM for the condenser and a pump motor PM for circulating the water to be frozen are disposed parallel to each other between the contact f of the temperature detector $Th_1$ and the power supply line B. The contact g of the temperature detector $Th_1$ is connected to the power source terminal m for driving an actuator motor AM (which performs tilting and resetting of the water tray 4) to cause the water tray 4 to be tilted, whereas the power supply terminal k of the actuator motor is connected to the power supply line B. The contact c of the changeover switch $S_2$ and the power source terminal n for driving the actuator motor AM to cause the water tray 4 to be reset are connected through a temperature detector $Th_2$, and further a hot gas valve HV and a water feed valve WV are disposed parallel to each other between the contact c and the power supply line B.

Next, operation of the automatic ice making machine having such constitution will be described. A power switch (not shown) of the ice making machine is first turned on. Since no ice cake is stored in the ice reservoir 13 at this stage, the ice formation detector switch $S_1$ is closed and the contact a of the change-over switch $S_2$ is connected to the contact b. The temperature of the freezing chamber 1 is substantially maintained at room temperature, so that the contact e of the temperature detector $Th_1$ is connected to the contact f. Accordingly, as soon as the power switch is turned on, the compressor (CM) 20, fan motor FM, pump motor PM and timer T are energized to start ice making operation. Then, the cooling medium and the water to be frozen are circulated as explained above referring to FIGS. 1 and 2, and thus the temperature of the water and that of the freezing chamber 1 are gradually lowered. When the machine is performing normal ice making operation, the temperature of the water circulated becomes 0° C. after a predetermined time from the starting point of the ice making operation to cause ice cakes to grow in the freezing chamber 1.

When the temperature of the freezing chamber 1 drops to a predetermined range after ice cakes are formed, the temperature detector $Th_1$ detects it to connect the contact e to the contact g; whereupon the fan motor FM and the pump motor PM are deenergized and the actuator motor AM is energized to start ice releasing operation. Upon rotation of the actuator motor AM, the water tray 4 and the water tank 5 start to tilt, and after completion of the tilting motion, the contact a of the change-over switch $S_2$ is changed over to the contact c, wherein the temperature detector $Th_2$ is assuming an open posture. The changing over of the change-over switch $S_2$ shuts off the power supply to the timer T and urges the water feed valve WV to be open, whereby another portion of uncooled fresh water is supplied to the tank 5 from the external water supply system. With the opening of the hot gas valve HV, the evaporator 3 is warmed to accelerate the ice releasing operation. As described above, the ice cakes formed in the freezing cells 2 drop by their own weight, and when the temperature of the freezing chamber 1 rises, the temperature detector $Th_2$ detects it and assumes a closed posture.

The actuator motor AM is energized when the temperature detector $Th_2$ is closed to start reverse rotation and allow the water tray 4 to reset; and after completion of the resetting motion, the contact a of the change-over switch $S_2$ is changed over to the contact b to resume the ice making operation and repeat the above procedures.

When a predetermined amount of ice cakes are accumulated in the ice reservoir 13 after repetition of the cycle of ice making operation and ice releasing operation, the ice formation detector switch $S_1$ assumes an open posture to terminate the ice making operation.

In the above process, if the condensing power is lowered due to rise of the environmental temperature or clogging in the condenser, the freezing power is also lowered to require longer time for the formation of ice cakes than the preset time of the timer T. On the other hand, if the clogging is heavy, the temperature of the freezing chamber 1 does not drop, even if the ice making operation is performed, to form no ice cake. In such occasion, the timer T counts up prior to the completion of ice formation and closes the contact $T_1$ in this embodiment. Then, a circuit: power supply line A→ fuse F→ ice formation detector switch $S_1$→ connecting point H→ reset push button PB→ contact $T_1$→ relay X and alarm lamp L→ power supply line B is formed, whereby the alarm lamp L lights up to externally notify presence of abnormality. It should be noted that since the normally open contact $X_1$ of the relay X is closed at that time to retain continuity of the relay X on its own, the alarm lamp L remains as lit even after the contact $T_1$ of the timer T is made open.

When the alarm lamp L is lit up, the user of the ice making machine recognizes the reduction of freezing power or incapability of making ice cakes due to clogging in the condenser and the like. When the reset push button PB is depressed after trouble shooting to release the contact $T_1$ or when the power source is temporarily shut off, the self-retention of the continuity of the relay X can be released, and the ice making operation is resumed.

In the apparatus according to the present embodiment, since the alarm unit is designed to give an alarm after a predetermined preset time counted from the starting point of the ice making operation, provided that the ice formation detector has outputted no ice formation signal, it never happens that the temperature element detect the phenomenon of temporary temperature rise in the cooling medium on the discharge side of the condenser at the initial stage of the ice making operation to give an alarm, but an alarm is surely given when any trouble has occurred, so that the user can immediately cope with the trouble effectively.

Figure 4:
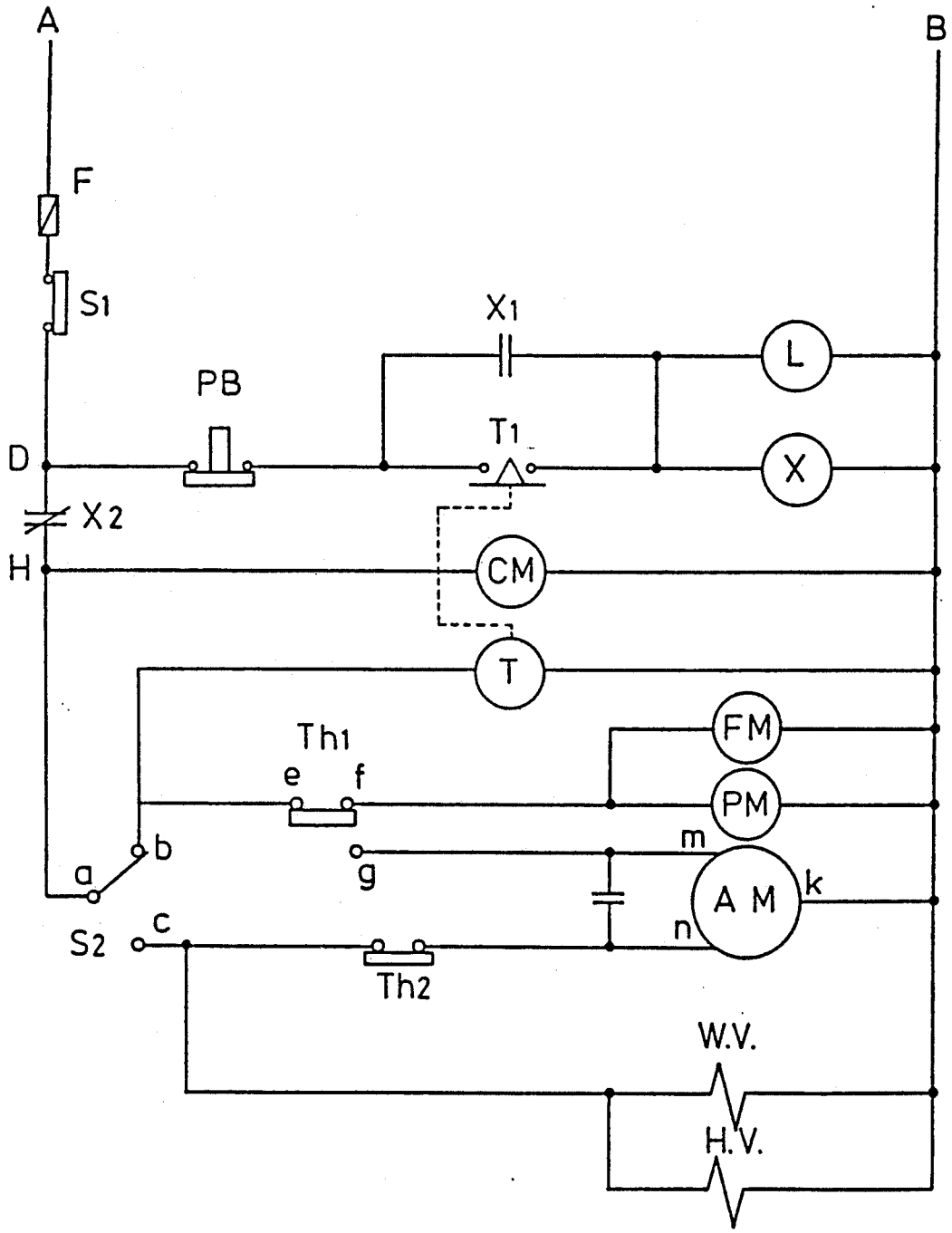
FIG. 4 shows an electric control circuit diagram of a second embodiment of the automatic ice making machine of this invention.

FIG. 4 shows an electric control circuit diagram according to a second embodiment of the automatic ice making machine. The difference between the first embodiment shown in FIG. 3 and the second embodiment is only that the relay X in the latter embodiment additionally has a normally closed contact $X_2$ being interposed between the connecting point D connecting the ice formation detector switch $S_1$ with the reset push button PB and the connecting point H connecting the compressor CM and the change-over switch $S_2$.

According to the second embodiment, at the moment the timer T has counted up to close the contact $T_1$ due to some trouble, the alarm lamp L is lit up like in the first embodiment, and the normally closed contact $X_2$ of the relay X is designed to be open to shut off the power supply to the compressor CM, fan motor FM and pump motor PM and stop the operation of the ice making machine. Incidentally, the open posture of the normally closed contact $X_2$ is retained by the relay X on its own.

According to this embodiment, since the operation of the ice making machine is entirely stopped in case of trouble, those troubles which may occur when the ice making operation is continued without being recognized by the user can be avoided effectively.

To describe the troubles in detail, if the ice making machine is continued to operate even after any trouble which causes to lower the freezing power has occurred, the pressure of the cooling medium in the high pressure circuit side in the freezing system rises and also that of the cooling medium in the low pressure circuit starting from the discharge side of the capillary tube to the suction side of the compressor rises, whereby the compressor is subjected to overload to increase the power demand, since not only the amount of the cooling medium under circulation is increased but also the compressor is not cooled well (cooling of the internal portion of the compressor by the forced air cooling with the fan motor and by the gaseous cooling medium sucked therein) to overheat the compressor.

If such condition occurs, the motor protector of the compressor is actuated to stop energization of the compressor. However, if the compressor is stopped, the pressure of the cooling medium within the freezing circuit is gradually lowered, and the temperature of the compressor itself gradually drops as the result of natural heat dissipation, whereby the motor protector is automatically reset to start energization of the compressor which then resumes the overload operation. Namely, the compressor repeats the above overload operation and stopping alternatively. This causes not only the waste of power but also deterioration of the ice machine oil to accelerate abrasion of the sliding section, leading to a serious damage that the compressor itself burns. The present embodiment can effectively prevent occurrence of such damage.

Figure 5:
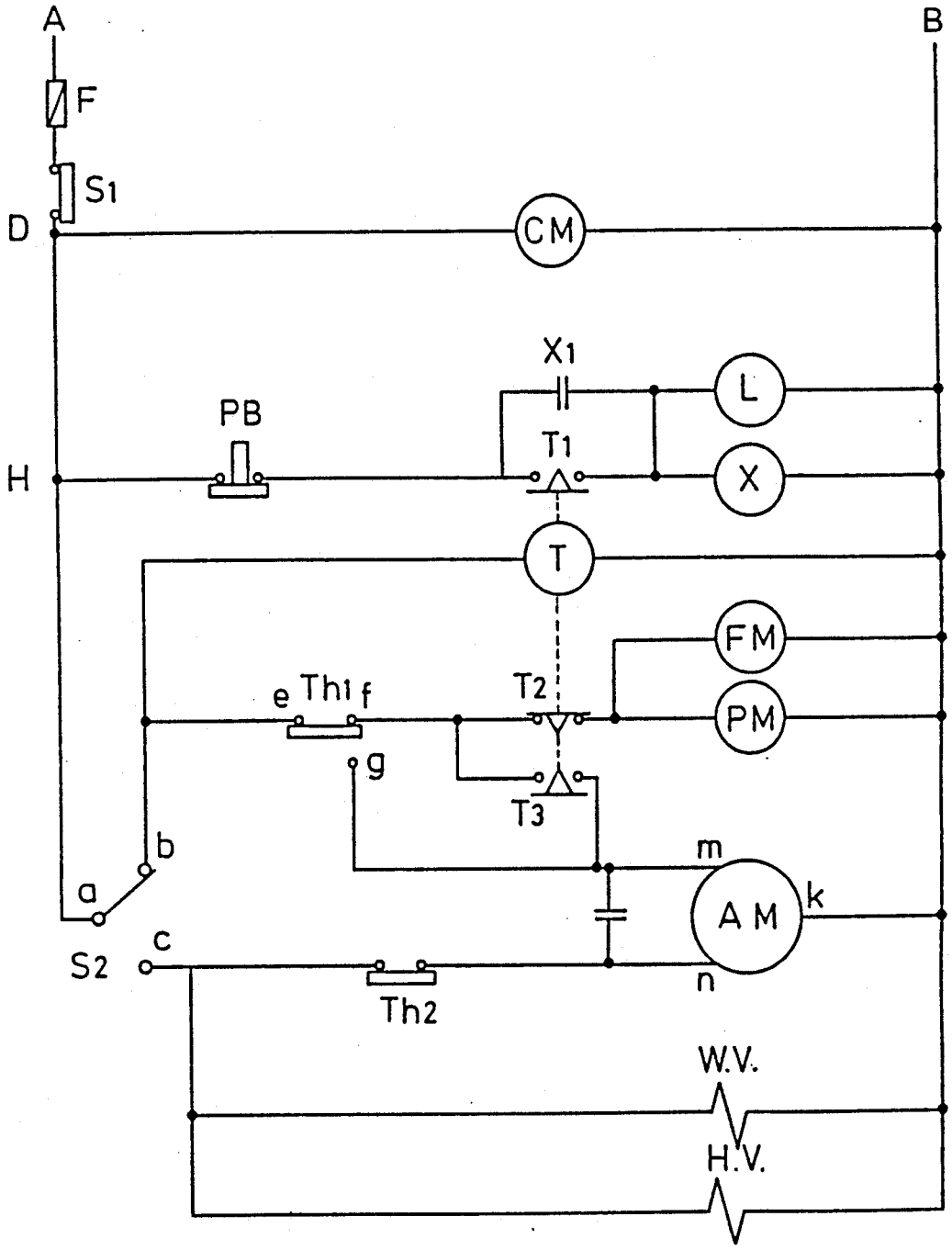
FIG. 5 shows an electric control circuit diagram of a third embodiment of the automatic ice making machine of this invention.

FIG. 5 shows a third embodiment of the electric control circuit diagram of the automatic ice making machine. The difference between the first embodiment shown in FIG. 3 and the third embodiment is only that a normally closed contact $T_2$ for the timer T is interposed between the contact f of the temperature detector $Th_1$ and the point connecting the fan motor FM and the pump motor PM, and also a normally open contact $T_3$ for the timer T is disposed between the contact f and the point connecting the terminal m for driving the actuator motor AM to cause the water tray 4 to be tilted, in the latter embodiment.

According to the third embodiment, when the timer T has counted up after occurrence of any trouble, the alarm lamp lights up like in the first embodiment, and besides the normally closed contact $T_2$ is made open to stop the fan motor FM and the pump motor PM, and also the normally open contact $T_3$ is closed to drive the actuator motor AM to cause the water tray 4 to tilt. When the water tray 4 is fully tilted, the contact a of the change-over switch $S_2$ is changed over to the contact c, and the ice releasing operation is resumed.

In case the environmental temperature has risen or a relatively light trouble occurred, ice cakes have grown although insufficient within the freezing chamber during the ice making operation. Even when the timer T has counted up the predetermined preset time, the ice releasing operation is started in the present embodiment, so that the desired amount of ice cakes can be secured effectively.

In the above embodiments, while condenser clogging was described as an example of trouble, the cause of abnormality with which the present invention can cope is not limited thereto, and the present invention is applicable to any of the cases where the ice making operation is extended or ice making is infeasible for some reasons. This invention can effectively cope, for example, with leakage of the cooling medium in the freezing system, compressor trouble, malfunction of the hot gas valve in the freezing system, water leakage due to the malfunction of the water feed valve in the external water supply system, trouble in the ice formation detector, trouble in the fan motor for the condenser, trouble in the pump motor for circulating the water to be frozen, actuator motor trouble, trouble in the change-over switch $S_2$, leakage or clogging in the water tray or the water feed system, trouble in the driving section of the ice making section, suspension of water supply, etc.

While the automatic ice making machine according to this invention has been described heretofore by way of preferred embodiments, this invention is not intended to be limitatively used in the closed cell system ice making machine but in various types of ice making machines of open cell system, flow-down system, etc. On the other hand, while a temperature detecting mode using a temperature element such as thermistor has been described as an example of the means for detecting the completion of ice formation, this invention can be applied to all of the ice making machines employing any of the timer system, water level detection system, pressure detection system, ice thickness detection system, temperature and timer system, etc. In the above preferred embodiments, while a relay was used as a constituent of the alarm unit, the present invention is not limited thereto and it is possible to use electronic parts in combination with the respective detection means or timer. The alarm unit may not be limited to the alarm lamp and it may of course be a unit which gives an alarm sound such as buzzer.

What is claimed is:

1. An automatic ice making machine having an ice making section equipped with an evaporator connected to a freezing system, a water feed system for feeding a water to be frozen to said ice making section, an ice formation detector which detects completion of forming ice cakes in said ice making section, and an ice releasing unit which releases the ice cakes formed in the ice making section upon receipt of ice formation signal from said ice formation detector;

characterized in that said ice making machine further comprises an alarm unit including a timer, said timer being preset to a time period slightly longer than a time required for normal ice making operation, and if said ice formation detector does not detect completion of forming of ice cakes before the expiration of said time period in said timer, said alarm unit generates an alarm.

2. The automatic ice making machine according to claim 1, wherein the alarm unit is designed to give a predetermined alarm and also to actuate the ice releasing unit.

3. The automatic ice making machine according to claim 1, wherein the alarm unit is designed to give a predetermined alarm and also to stop the operation of the ice making machine.

4. The automatic ice making machine according to any of claim 1, wherein the ice formation detector is any of temperature detection system, pressure detection system and ice thickness detection system.

* * * * *